United States Patent [19]

Shepard et al.

[11] Patent Number: 5,046,246

[45] Date of Patent: Sep. 10, 1991

[54] SECURING MACHINE PARTS TOGETHER WITH THE AID OF CONNECTING PINS

[75] Inventors: Spencer H. Shepard; Phillip D. Lloyd; Eddie J. Reames, all of Charlotte, N.C.; Jon P. Freudenthal, Rock Hill, S.C.; Albert J. Partington, Winter Springs, Fla.

[73] Assignee: Westinghouse Electric Corp., Pittsburgh, Pa.

[21] Appl. No.: 580,990

[22] Filed: Sep. 12, 1990

[51] Int. Cl.[5] ..... F01D 5/32

[52] U.S. Cl. ..... 29/889.21; 29/889.71; 29/407; 29/433; 29/447; 29/525; 29/525.1; 29/418

[58] Field of Search ..... 29/889, 889.2, 889.21, 29/889.71, 890.125, 407, 433, 447, 525, 525.1, 418; 416/217, 220 R

[56] References Cited

U.S. PATENT DOCUMENTS

| | | | |
|---|---|---|---|
| 919,853 | 4/1909 | Green | 29/889.21 |
| 1,955,728 | 4/1934 | Allen et al. | 29/447 |
| 2,326,145 | 8/1943 | Kroon | 416/217 |
| 3,160,188 | 12/1964 | Frank | 29/525.1 |
| 3,381,355 | 5/1968 | Bixby | 29/433 |
| 4,460,316 | 7/1984 | Partington | 416/217 |
| 4,694,634 | 9/1987 | Anderson et al. | 29/418 |

*Primary Examiner*—P. W. Echols
*Assistant Examiner*—David P. Bryant

[57] ABSTRACT

Machine parts are connected together to form an assembly by means of pins which form an interference fit with passages in the parts and whose ends are flush with two opposed surfaces of the assembly. Each pin is provided with an annular groove spaced from one end of the pin by a distance equal to the distance between the opposed surfaces. A positioning member is seated in the groove and the pin is inserted into an associated passage so that the positioning member bears against one opposed surface. After a tight fit is achieved, the protruding portion of the pin is broken away.

A device is provided for testing the tightness of an inserted pin. The device may engage the annular groove and apply a tensile test force. Alternatively, after the end of the pin has been broken away, the device may bear against the end of the remaining pin portion and apply a compressive test force.

12 Claims, 2 Drawing Sheets

SECURING MACHINE PARTS TOGETHER WITH THE AID OF CONNECTING PINS

BACKGROUND OF THE INVENTION

The present invention relates to the use of connecting pins for securing machine parts together, particularly in situations where the connecting pins should be flush with opposed surfaces of the parts which are connected together.

In the assembly of many machines, it is convenient to employ connecting pins for securing machine parts together. Frequently, it is desirable that the ends of these connecting pins be flush with associated surfaces of the connected parts. Such connecting arrangements are employed, for example, to fastened control stage turbine blade units to a turbine rotor or disc.

Such an arrangement is shown in FIG. 1, where a turbine blade unit 2 is fastened to a disc or rotor 4 carried on a rotor shaft 6. Turbine blade unit 2 is provided with a root portion composed of a plurality of plates 8 which fit into circumferential grooves in disc 4. Disc 4 and plates 8 are provided with passages, for example circular holes, for receiving connecting pins 10. When the parts are connected together, pins 10 will extend between opposed, parallel surfaces 12 which here are radial surfaces of disc or rotor 4.

For the purpose illustrated in FIG. 1, and for similar purposes in other machines, connecting pins 10 must fit tightly enough to prevent relative motion between the parts which they connect together, even if one of the parts is subjected to intermittent shock forces. Moreover, it is desirable, and often essential, that the length of the pins correspond precisely to the distance between surfaces 12 and that the ends of the pins fit flush with those surfaces.

If the ends of the pins were not flush with the end surfaces of the assembly, this can create turbulence during high speed turbine operation, which turbulence would contribute to the aerodynamic resistance of the rotating parts and produce a certain degree of wear. Moreover, protruding pins may strike stationary surfaces within the turbine and would mar the appearance of the assembly.

This means that each pin must not only be of the correct length, but must be inserted to precisely the correct depth; if a pin of correct length is inserted too far, or if the pin is too long, it will project from one surface of the parts which are connected together, and this will frequently be unacceptable. Since the manufacture of connecting pins to initially have precisely the desired length for a given installation is impractical, current practice is to manufacture such pins so that they are initially longer than required. Each pin is then inserted so that both ends project from the parts being connected together. In the case of the device shown in FIG. 1, such pins would project beyond both surfaces 12. One manner of inserting such pins is to freeze the pins, for example in liquid nitrogen, after which the pins are quickly inserted and allowed to return to ambient temperature, while expanding, to produce the desired interference fit. Then, the excess portion of each pin is machined away at both surfaces 12.

This procedure has a number of inherent drawbacks. Firstly, machining is a slow and expensive process particularly since, in many situations, the connecting pins must be of a high strength material with a suitable coefficient of thermal expansion, and such materials are relatively hard. In addition, the machining process is one of the last operations performed in the assembly of a structure such as that shown in FIG. 1 and any delays in this process can have a significant impact on completion of the assembly on schedule. Finally, the connecting pin material will frequently be harder than that of the parts which are connected together so that when the ends of a connecting pin are machined flush with the surfaces of the connecting parts, an unacceptable amount of the connecting part surfaces may be machined away at the same time.

If it were attempted to obviate these difficulties by giving a pin the desired length before insertion, it is possible for a pin to be inserted too far with the result that one end of the pin would be recessed and the other end protruding. Such an installation is not acceptable. In installations of the type here under consideration, it is not possible to simply force the pin back in the opposite direction because the pin will have already reached a temperature at which it is fixed in place.

After a pin has been properly inserted, the tightness of its fit in its associated passage must be tested. Current practice involves placing an instrument against one end of the pin and then striking the instrument with a hammer, an effort being made to strike the pin with a selected force. Inherently, it is difficult to control the force produced by a hammer blow. Therefore, when this technique is employed, it will frequently occur that the force of the hammer blow is too low or too high. In the former case, a pin whose fit is not sufficiently tight will appear to be acceptable, while in the latter case, an acceptable pin may be dislodged. Frequently, if a pin is dislodged, it can not be repositioned because there is not sufficient room adjacent to the opposite end of the pin for introduction for an appropriate tool.

SUMMARY OF THE INVENTION

It is an object of the present invention to facilitate proper installation of such connecting pins.

Another object of the invention is to assure reliable insertion of such connecting pins to the desired depth.

Yet another object of the invention is to facilitate establishment of the correct length for each connecting pin.

Another object of the invention is to eliminate the risk of damage to the surfaces which are to be flush with the ends of a connecting pin.

Still another object of the invention is to facilitate testing of the tightness of each such pin.

The above and other objects are achieved, according to the invention, by a method for securing machine parts together to form an assembly having two opposed surfaces, the parts being formed to define a passage receiving at least one connecting pin which extends between, and is substantially flush with, the two opposed surfaces of the assembly, comprising;

providing a connecting pin having a length greater than the distance between the two opposed surfaces;

forming a groove in the connecting pin at a distance from a first end of the pin which is equal to the distance between the two opposed surfaces;

mounting a positioning member in the groove and inserting the pin into the passage so that the first end is flush with one opposed surface and the positioning member bears against the other opposed surface; and breaking off the pin at the groove so that the portion of the pin between the first end and the groove remains secured in the passage.

DESCRIPTION OF THE PREFERRED EMBODIMENTS

Figure 2:
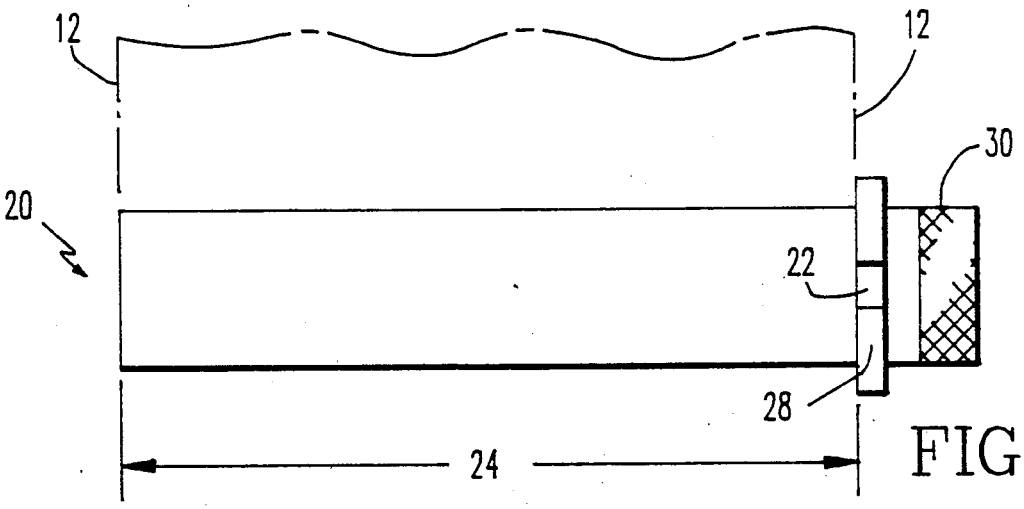
FIG. 2 is a side view of a connecting pin used in the practice of the present invention, in its original configuration.
Figure 5:
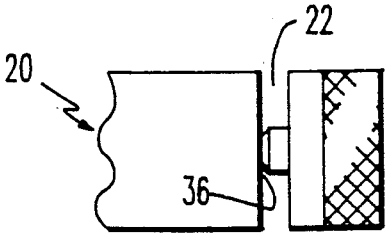
FIG. 5 is a cross sectional detail view of one end of the pin of FIG. 2.

FIG. 2 shows one embodiment of a connecting pin 20 used in the practice of the present invention. Pin 20 is initially manufactured to have a length which is greater than the spacing between surfaces 12, shown for reference purposes in FIG. 2. Pin 20 is provided with an annular groove 22 which is a short distance from one end of pin 20 and which is spaced from the other end by a distance 24 equal to the spacing between surfaces 12.

Figure 1:
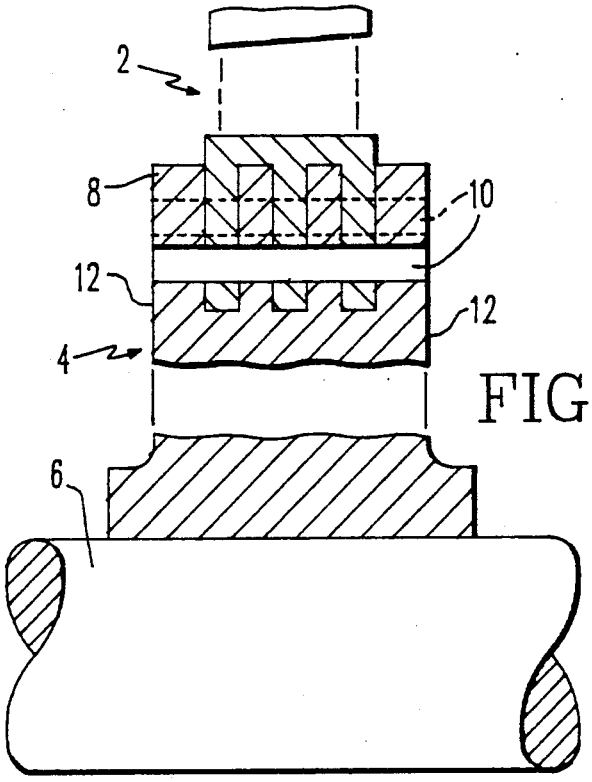
FIG. 1 is a detail view, partly in cross section, of an assembly composed of parts which are connected together by connecting pins.

Then a washer 28 is inserted into groove 22 and pin 20 is cooled to a very low temperature and inserted into a passage, such as the passage formed in parts 4 and 8 in FIG. 1. Washer 28 assures that pin 20 is inserted to precisely the correct depth so that the left-hand end of pin 20 is flush with the left-hand surface 12.

Then the excess portion of pin 20 at the right-hand end thereof is eliminated by striking pin 20 at location 30 in order to break the pin off at groove 22.

Figure 3:
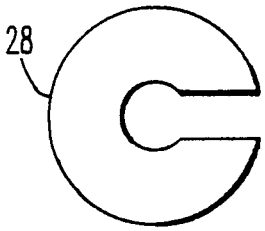
FIGS. 3 and 4 are front views of two embodiments of a component mounted on the pin in FIG. 2.
Figure 4:
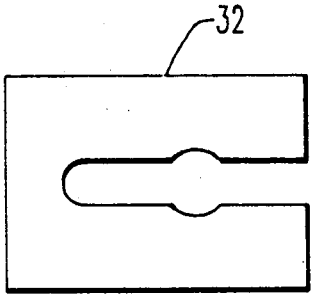

Washer 28 may have the outline shown in FIG. 3, or may have the form of washer 32 shown in FIG. 4. Washer 28 (or 32) may be removed from groove 22 before breaking off the projecting end of pin 20.

The cross-sectional configuration and length of groove 22 will be selected to assure that pin 20 will be broken off at the groove. Preferably, pin 20 should break off at the side of groove 22 that is flush with the associated surface 12. This may be achieved, for example, by providing groove 22 with a weakened region 36 at the location where breakage is to occur. Other forms of weakening may be employed. Thus, the pin portion which is broken away will include that part which defined groove 22.

According to a further feature of the invention, groove 22 may be used, after insertion of pin 20, as an attachment for applying a tensile test force to test the tightness of pin 20 in the passage into which it has been inserted, and after the pin has returned to ambient temperature.

Figure 6:
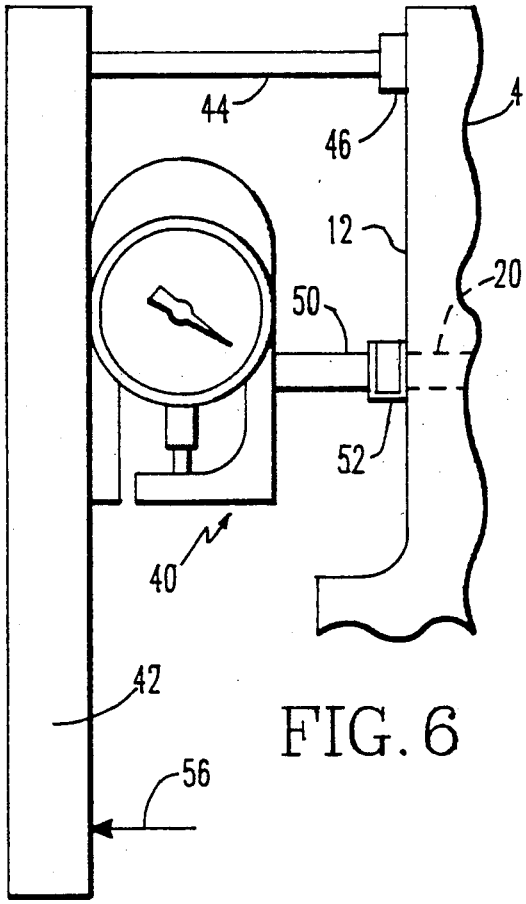
FIG. 6 is an elevational view of one embodiment of a pin tightness test unit according to the invention.
Figure 7:
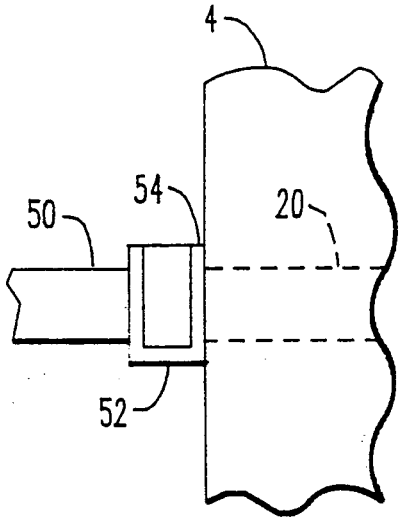
FIG. 7 is a detail view of a portion of the unit of FIG. 6.

This test may be performed according to the invention, utilizing the unit shown in FIG. 6. This unit includes a tension gage 40 which may be of a commercially available type. Suitable gages having the form illustrated in FIG. 7 are marketed by the company Dillon Weight-tronix, Inc., under the model designations X-ST and X-PP. Gage 40 is fixed to an intermediate region of a lever arm 42 which is provided at one end with a support rod 44. Rod 44 carries, at its end remote from lever arm 42, a seated member 46 which bears against a surface 12 of disk or rotor 4.

Gage 40 further includes a threaded opening (not shown) for connection to a component to which a tensile force is to be applied. In accordance with the present invention, this opening receives a rod 50 whose free end carries a specially designed grasping member 52 having a generally U-shaped configuration. Grasping member 52 has, at its free end, a disk-shaped part 54 which may have a configuration similar to that of washer 28. Part 54 is constructed to seat in groove 22, and thus firmly engage the protruding portion of pin 20 before that portion is broken off. In order to perform a tightness test, a force is applied to lever arm 42 at location 56 until the desired tensile force has been applied to pin 20 as shown by the indicator of gage 40. When the desired tensile force value is reached and the pin is found to be tightly seated in its associated passage, the test unit may be removed and the protruding end of pin 20 may then be broken away. If pin 20 fails the tightness test, it can easily be removed by continuing to act on lever arm 42 and a new pin can be inserted. This is advantageous because the tensile test can be performed at the side of rotor or shaft 4 via which pin 20 was originally inserted and at which there is sufficient clearance to perform these operations.

To allow such a tightness test to be performed, groove 22 is dimensioned to ensure that the portion of pin 20 remaining in the region of groove 22 is sufficient to withstand the tensile force which must be applied to adequately test pin tightness. As a general rule, groove 22 can easily be dimensioned to have this capability, while nevertheless permitting a lateral blow at location 30 (FIG. 2) to effect the desired breaking away of the protruding portion of pin 20.

To enable this testing to be performed in an effective and nondestructive manner, the present invention further provides a compressive testing unit having a form similar to that in FIG. 6.

The manner in which grasping member 52 engages the protruding portion of pin 20 is shown in greater detail in FIG. 7.

At some time after the projecting portion of pin 20 has been broken away, it may be necessary to again test pin tightness. In addition, pins inserted in accordance with the prior art must also have their tightness tested, at least immediately after installation, and possibly after specified periods of operation of the equipment in which they are installed. Since such pins do not have a protruding portion, testing by application of a tensile force is not feasible. The present invention further provides a novel unit for testing such pins in a simple and reliable manner.

Figure 8:
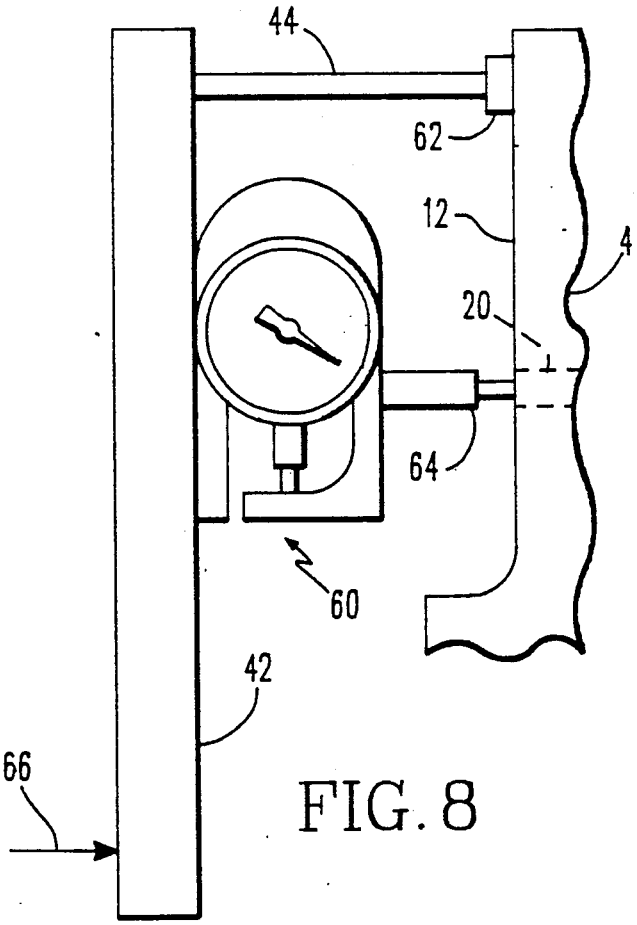
FIG. 8 is a view similar to that of FIG. 7 of another embodiment of a tightness testing unit according to the invention.

One embodiment of such a testing unit according to the present invention is illustrated in FIG. 8 and has a form similar to that of unit 6. In this embodiment, there is provided a compression force gage which may be constituted by a gage manufactured under the same brand name as indicated above with model designation X-C. Gage 60 is mounted on lever arm 42. In this embodiment, the free end of support rod 44 carries a clamping plate 62 which will be clamped to disk or rotor 4. Secured to gage 60 is a push rod having a portion of reduced diameter at its free end for engaging the associated end of a pin 20.

For testing the tightness of pin 20 in its associated passage, an appropriate force is applied at location 66 and the force is increased until gage 60 indicates that the desired compressive test force is being applied to pin 20. If, upon application of the selected compressive force, pin 20 remains in position, acceptable pin tightness is judged to exist. Plate 62 is then unclamped and the device can be positioned for testing another pin.

While the description above relates to particular embodiments of the present invention, it will be understood that many modifications may be made without departing from the spirit thereof. The pending claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

We claim:

1. A method for securing machine parts together to form an assembly having two opposed surfaces, the parts being formed to define a passage receiving at least one connecting pin which extends between, and is substantially flush with, the two opposed surfaces of the assembly, comprising;

providing a connecting pin having a length greater than the distance between the two opposed surfaces;

forming a groove in the connecting pin at a distance from a first end of the pin which is equal to the distance between the two opposed surfaces;

mounting a positioning member in the groove and inserting the pin into the passage so that the first end is flush with one opposed surface and the positioning member bears against the other opposed surface; and breaking off the pin at the groove so that the portion of the pin between the first end and the groove remains secured in the passage.

2. A method as defined in claim 1 further comprising removing the positioning member from the groove after said step of inserting and before said step of breaking off.

3. A method as defined in claim 1 further comprising temporarily shrinking the pin prior to said step of inserting.

4. A method as defined in claim 1 wherein said step of inserting is carried out so that a portion of the pin remote from the first end projects away from the other opposed surface of the assembly, and said step of breaking off is carried out to remove substantially the entire projecting portion of the pin.

5. A method as defined in claim 4 wherein said step of breaking off is carried out by striking the projecting portion of the pin in a direction transverse to the length of the pin.

6. A method as defined in claim 1 further comprising providing the pin with a weakened region at a location which will be flush with the other opposed surface of the assembly when the positioning member bears against the other opposed surface.

7. A method as defined in claim 1 further comprising, after said step of inserting, and before said step of breaking off, testing the resistance of the pin to movement in the passage.

8. A method as defined in claim 7 wherein said step of testing comprises removing the positioning member from the groove, engaging the groove with a tensile force gage, and applying a tensile force to the pin via the gage.

9. A method as defined in claim 8 wherein the gage has a force indicator and said step of testing further comprises monitoring the force indicator during said step of applying a tensile force.

10. A method as defined in claim 1 further comprising, after said step of breaking off, applying a controlled compressive force to the pin in the direction of the length of the pin in order to test the resistance of the pin to movement in the passage.

11. A method as defined in claim 10 wherein said step of applying a compressive force to the pin comprises engaging one end of the pin with a compressive force gage, and applying the compressive force to the pin via the gage.

12. A method as defined in claim 11 wherein the gage has a force indicator and said step of applying a compressive force further comprises monitoring the force indicator while applying the compressive force.

* * * * *